US005359531A

United States Patent [19]

Iwamoto et al.

[11] Patent Number: 5,359,531

[45] Date of Patent: Oct. 25, 1994

[54] METHOD OF AND APPARATUS FOR DISPLAYING CASTING-DATA IN DIE-CAST MACHINE

[75] Inventors: Norihiro Iwamoto; Masayuki Takamura, both of Zama, Japan

[73] Assignee: Toshiba Kikai Kabushiki Kaisha, Tokyo, Japan

[21] Appl. No.: 818,151

[22] Filed: Jan. 8, 1992

[30] Foreign Application Priority Data

Jan. 9, 1991 [JP] Japan ..... 3-023651

[51] Int. Cl.[5] ..... G06F 15/46; B22D 17/32

[52] U.S. Cl. ..... 364/476; 164/452; 164/154.1; 364/188

[58] Field of Search ..... 364/476, 473, 188, 189, 364/191–193, 558, 550; 264/40.1, 40.5, 40.7, 328.1, 328.2; 425/149, 150, 170, 171, 173, 135; 164/150, 154, 155, 157, 4.1, 451, 452

[56] References Cited

U.S. PATENT DOCUMENTS 3,840,312 10/1974 Paulson et al. ..... 364/476 X
4,094,940 6/1978 Hold ..... 364/476 X
4,328,549 5/1982 Avery ..... 364/476 X
4,493,362 1/1985 Moore et al. ..... 364/476 X
4,674,053 6/1987 Bannai et al. ..... 364/476
4,823,274 4/1989 Kiya et al. ..... 364/476
5,005,116 4/1991 Fujita et al. ..... 364/476 X
5,191,539 3/1993 Harada et al. ..... 364/476
5,200,126 4/1993 Wenskus, Jr. et al. ..... 264/40.1

*Primary Examiner*—Joseph Ruggiero
*Attorney, Agent, or Firm*—Cushman, Darby & Cushman

[57] ABSTRACT

An apparatus for displaying casting-data in a die-cast machine having a plurality of sensors which gather data values such as speed, pressure and temperature. A converter processes signals from sensors, and an input-calibration mechanism may be provided for correcting the processed signals and for issuing detected data. A casting-cycle data processing mechanism may be provided for displaying data items such as an injection speed or an injection pressure every casting cycle, based on the detected data. A casting control data processing mechanism may also be provided for displaying shot-time items and fluctuations through repeated injection cycles to monitor casting operation, where displays are based on the detected data from the input-calibration mechanism.

6 Claims, 18 Drawing Sheets

FIG. 12

130 131 132 133 134 135 136 137 138 139 1310

| ACCUMULATED TOTAL | SHOT | TIME | LOW VELOCITY | HIGH VELOCITY | RISE | PON | ADVANCE | HIGH REGION(≒HIGH VELOCITY) | Vh | DEFECTIVE FACTOR 1 2 3 4 5 6 | -(COMMENT)- |
|---|---|---|---|---|---|---|---|---|---|---|---|
| | | | m/s | m/s | mSec | kg/cm² | mSec | mm | m/s | | |
| DATE | <SETTING VALUE> | | 0.30 | 0.70 | 5.00 | 850. | 90.0 | 100. | 0.60 | | |
| 90/09/21 | <RANGE± > | | 0.07 | 0.10 | 5.00 | 25.0 | 25.0 | 10.0 | 0.10 | | |
| 41 | 41 | 115014 | 0.30 | 0.65 | 2 | 865 | 92 | 99.7 | 0.60 | ** | |
| 42 | 42 | 115044 | 0.30 | 0.65 | 2 | 866 | 90 | 98.1 | 0.58 | ** | |
| 43 | 43 | 115115 | 0.30 | 0.65 | 4 | 847 | 78 | 98.5 | 0.58 | | |
| 44 | 44 | 115145 | 0.30 | 0.65 | H 98 | 847 | 84 | H 129 | 0.54 | | |
| 45 | 45 | 115215 | 0.30 | 0.64 | 2 | 847 | 82 | 98.9 | 0.58 | | |
| 46 | 46 | 115246 | 0.30 | 0.64 | 2 | 847 | 82 | 100 | 0.60 | | |
| 47 | 47 | 115316 | 0.30 | 0.63 | H 184 | 847 | 84 | H 154 | L0.44 | | |
| 48 | 1 | 115517 | 0.30 | 0.65 | 2 | 847 | 84 | 100 | 0.60 | | |
| 49 | 2 | 115547 | 0.30 | 0.65 | 2 | 848 | 84 | 100 | 0.60 | | |
| 50 | 3 | 115618 | 0.31 | 0.66 | 2 | 847 | 84 | 99.7 | 0.60 | | |
| 51 | 1 | 120050 | 0.30 | 0.65 | 2 | 848 | 86 | 99.3 | 0.58 | | |
| 52 | 2 | 120120 | 0.30 | 0.66 | 2 | 864 | 96 | 98.5 | 0.58 | | |
| 53 | 3 | 120151 | 0.30 | 0.65 | 2 | 845 | 86 | 99.3 | 0.58 | | |
| 54 | 4 | 120507 | 0.31 | 0.67 | 2 | H 881 | 96 | 99.7 | 0.58 | | |
| 55 | 5 | 120638 | 0.30 | 0.65 | H 398 | 870 | 96 | H 221 | L0.33 | | |
| 56 | 6 | 120708 | 0.30 | 0.65 | 2 | 850 | 86 | 99.3 | 0.58 | | |
| 57 | 7 | 120739 | 0.31 | 0.66 | 2 | 850 | 88 | 99.3 | 0.58 | | |
| 58 | 8 | 120809 | 0.31 | 0.66 | 2 | 849 | 88 | 98.9 | 0.58 | | |
| 59 | 9 | 120839 | 0.30 | 0.65 | 2 | 849 | 88 | 99.7 | 0.60 | | |
| 60 | 10 | 120909 | 0.30 | 0.65 | 2 | 849 | 88 | 99.3 | 0.58 | | |

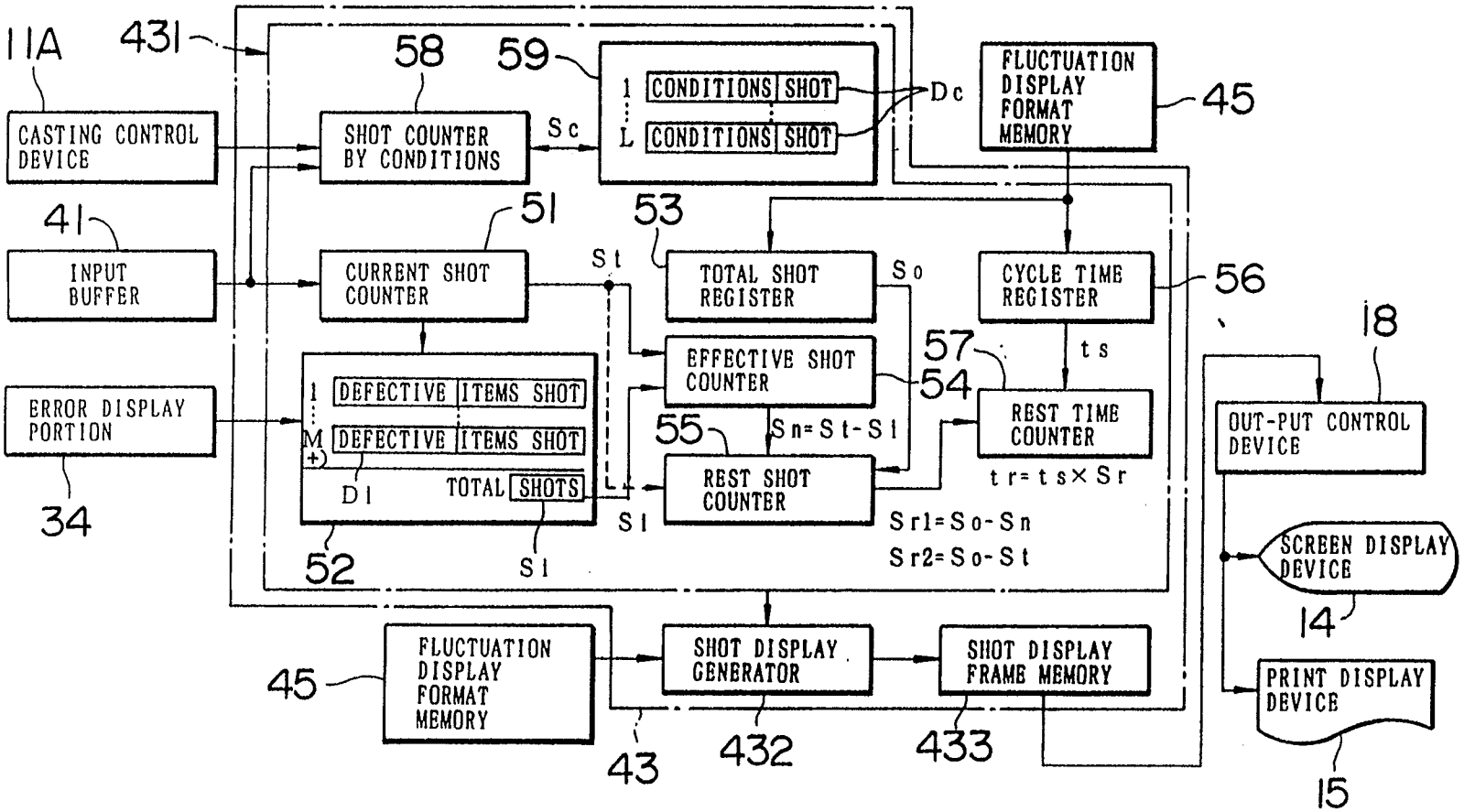
FIG. 15
CASTING CONTROL DEVICE
11A
431
INPUT BUFFER
41
ERROR DISPLAY PORTION
34
SHOT COUNTER BY CONDITIONS
58
59
CONDITIONS SHOT
CONDITIONS SHOT
Dc
Sc
CURRENT SHOT COUNTER
51
TOTAL SHOT REGISTER
53
EFFECTIVE SHOT COUNTER
54
REST SHOT COUNTER
55
DEFECTIVE ITEMS SHOT
DEFECTIVE ITEMS SHOT
TOTAL SHOTS
D1
52
CYCLE TIME REGISTER
56
REST TIME COUNTER
57
FLUCTUATION DISPLAY FORMAT MEMORY
45
OUT-PUT CONTROL DEVICE
18
SCREEN DISPLAY DEVICE
14
PRINT DISPLAY DEVICE
15
SHOT DISPLAY GENERATOR
432
SHOT DISPLAY FRAME MEMORY
433
43
FLUCTUATION DISPLAY FORMAT MEMORY
45
ts
tr=ts×Sr
Sr1=So-Sn
Sr2=So-St
Sn=St-S1
So
St
S1

METHOD OF AND APPARATUS FOR DISPLAYING CASTING-DATA IN DIE-CAST MACHINE

BACKGROUND OF THE INVENTION

1. Field of the Invention

This invention relates to a method of displaying casting-data in a die-cast machine, especially of monitoring and recording running conditions of the die-cast machine.

2. Description of the Art

Conventionally, monitoring and recording the running conditions of the die-cast machine are done by appropriate processing of output signals which are issued by sensors positioned at several portions of the die-cast machine. These processed output signals are then displayed via screen or print-out which indicates the casting operation conditions. The display format of the casting operation conditions is essentially preset by the manufacturer to lessen the burden of the machine user. Displayed data such as injection speed, injection pressure, cycle time and the like, as well as mathematically processed output data from sensors may be preset as described.

Since the functions of the die-cast machine have recently been expanded, many new types of data such as setting data and running condition data are expected to be optically shown.

However, data items needed by different users are naturally different from each other as some of the users wish to monitor only exclusive sets of data. Because the above-described conventional display method is preset, machine users are not able to change display formats easily when necessary. Further, it is difficult for a manufacturer to change the display format in compliance with a machine user's requirement due to the strictly preset display format.

Therefore, the preset display format can not satisfy each user's requirements to monitor specific data items or to change the definitions of error displays. The number and position of sensors for the die-cast machine are also determined during construction, consequently limiting users from employing other sensors having specific desired characteristics.

An object of the present invention is to provide a method of, and an apparatus for, displaying casting-data in a die-cast machine, which allows for a machine user to easily change one display format to another thereby monitoring all necessary data.

SUMMARY OF THE INVENTION

The present invention relates to a method of displaying casting-data in a die-cast machine for indicating casting operation condition of the die-cast machine on a screen or print display after processing output signals from sensors disposed at several points in the die-cast machine.

Accordingly, the first method includes selecting at least one data item to be displayed before casting operation; setting a rectangular coordinate system for displaying data values corresponding to the selected data item where one axis of the rectangular coordinate system is a data value axis for representing the selected data item and the other axis is a time axis for representing time progress for one injection cycle; and selecting one of four display formats in which the first format is a direct display format for displaying the data values of a present injection cycle, the second format is a start-adjusted display format for displaying the data values wherein a start position on its time axis is adjusted to a predetermined time after which a present injection cycle start signal is issued, the third format is a peak-adjusted display format for adjusting a peak position of the data values according to a predetermined position on the time axis, and the fourth format is a rise-adjusted display format for adjusting to a point where the actual data value exceeds a predetermined value according to a predetermined position on the time axis. In this method, the data values of selected data items are superimposed on the selected rectangular coordinate system successively in accordance with the selected display format while the die-cast machine is in operation.

The second method includes monitoring a plurality of sensors which are disposed at several points within the die-cast machine, selecting at least one data items corresponding to a sensoring output to be displayed, setting each display position for the selected data items before the casting operation, displaying the selected data items at title lines on the display whereby at least titles of the selected data items are shown during casting operation, and displaying present data values of the selected data items in succession on data lines which are divided at every injection cycle in conformity with display positions of the selected data items.

The third method, according to the present invention includes monitoring a plurality of sensors which are disposed at several points within the die-cast machine, selecting necessary data items for production management among shot-time items such as total shot-time, current shot-time and remaining shot-time, setting each display position for the selected data items before the casting operation, displaying the selected data items on the set display positions during the casting operation, and renewing each representation of selected data items for every injection cycle.

The fourth method in the present invention includes selecting at least one data item to be displayed, setting a rectangular coordinate system before the casting operation which has one axis as the data value axis corresponding to the selected data item and which has other axis as the shot-time axis corresponding to the injection cycle time, and plotting the data values on the rectangular coordinate system every injection cycle.

Incidentally, the second method may have included the steps of setting an allowable range and an error mark for each data item before the casting operation, and adding the error mark to that data item whose representation exceeds the allowable range.

Each method preferably also includes the steps of setting calibration data for each sensor before casting operation, and correcting each output signal of the sensors according to the calibration data.

Each method may further include storing set data in an auxiliary file and reading out the data from the auxiliary file for setting operation.

By the mentioned invention, display format can also be set before the casting operation so that a user can easily change the display format.

According to the first method, data can be displayed by a graph per injection cycle and superimposed to allow monitoring of injection mode. According to the second method, since data display per injection cycle can be shown by list format, complete supervision is available. According to the third method, operation progress can be monitored due to shot-time display, and according to the fourth invention, data fluctuation per shot can be monitored.

Hence, the user can set all formats, error displays, and calibration for sensors so that complete supervision is available. These settings can then be stored in an auxiliary file so that operation under them becomes more comfortable.

The mentioned method can be performed by the following apparatus. This apparatus displays casting-data in a die-cast machine having a plurality of sensors which detect such data value as speed, pressure and temperature. A converter is then used to process output signals from these sensors. The apparatus further includes an input-calibration device for correcting the output signals from the converter and for issuing detected data, a casting-cycle data processing mechanism for displaying data items such as injection speed and injection pressure every casting cycle based on the detected data, and casting control data processing mechanism for displaying shot-time items and fluctuations through repeated injection cycles to monitor casting operation based on the detected data from the input-calibration means.

BRIEF DESCRIPTION OF THE DRAWINGS

FIG. 12 is a list display screen;

FIG. 15 is a block diagram showing a shot display portion;

DETAILED DESCRIPTION OF THE PRESENTLY PREFERRED EXEMPLARY EMBODIMENTS

The following is the best mode embodiment of the present invention.

Figure 1A:
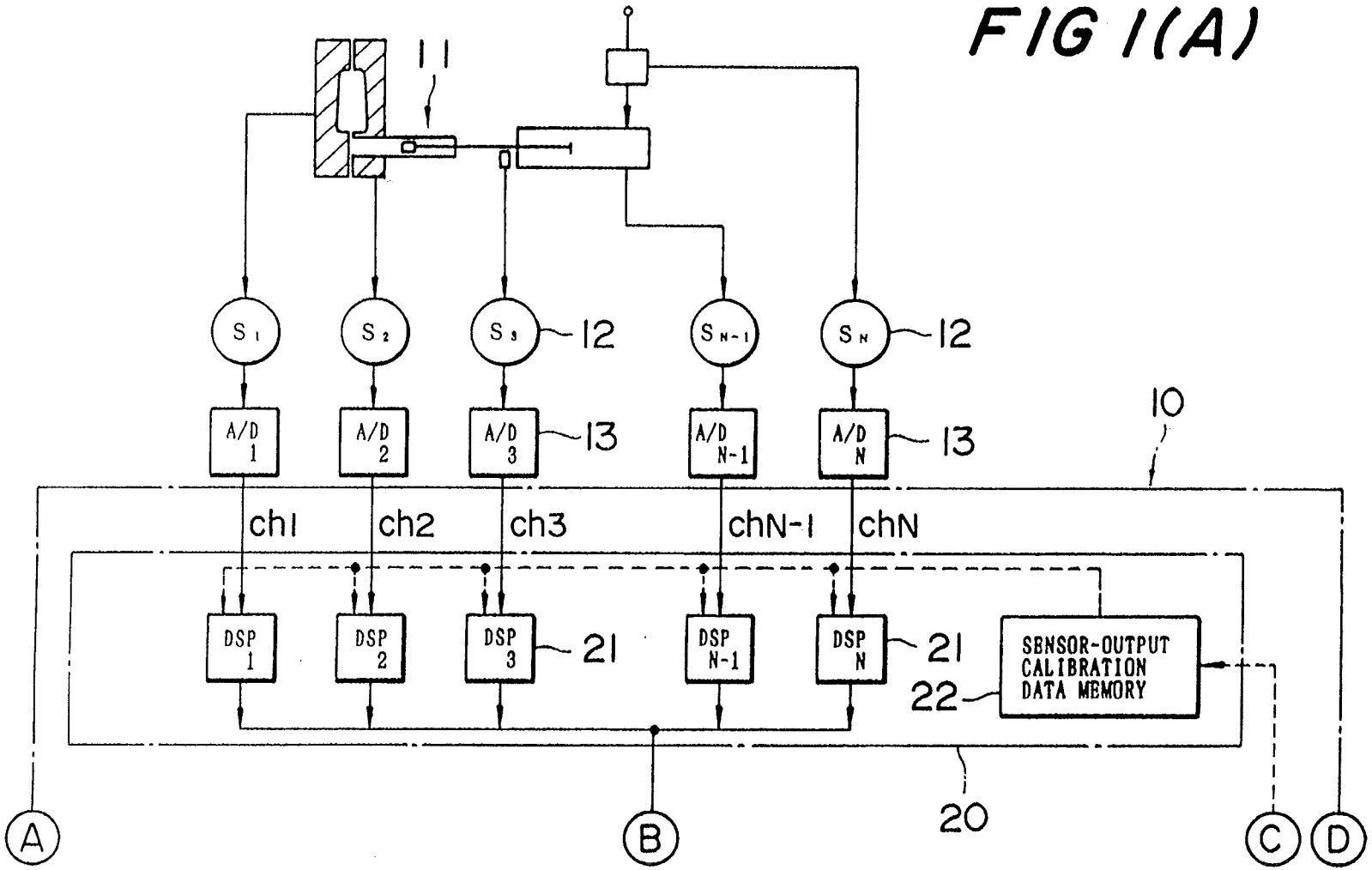
FIG. 1(A) and FIG. 1(B) show a single block diagram of the entire arrangement for the best mode embodiment in the present invention.
Figure 1B:
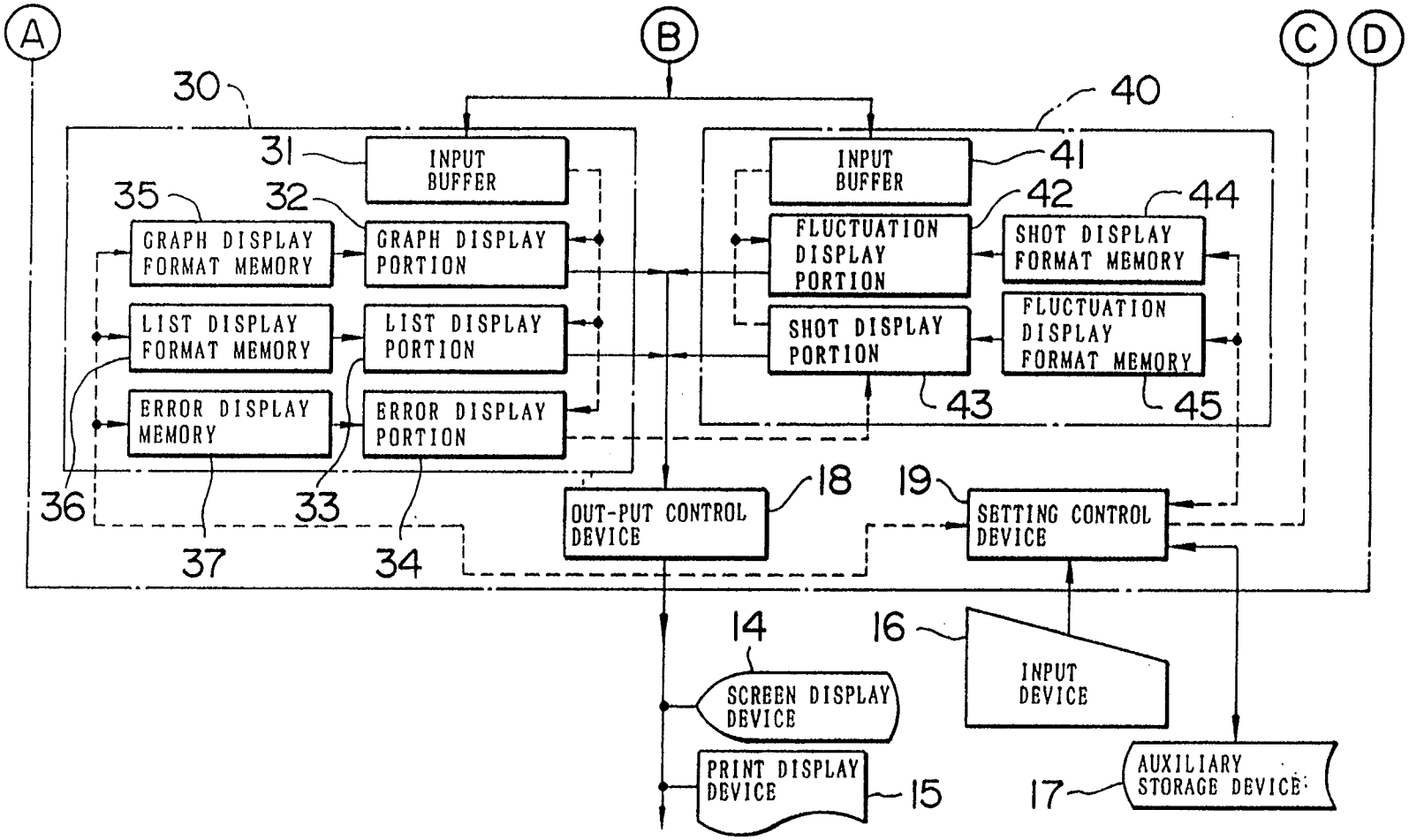

Shown in FIG. 1, a casting-data display apparatus 10 for a die-cast machine 11 is provided to display casting-data in the die-cast machine 11.

Die-cast machine 11 has a plurality of sensors 12 for detecting data such as speed, pressure and temperature. Each of the sensors is connected to one input channel, which range from ch1 through chN of display apparatus 10 via A/D converter 13.

The preferred embodiment has display apparatus 10 additionally connected to screen display device 14, print display device 15, input device 16, and auxiliary storage device 17, wherein screen display device 14 is a bit-map type display for graphically displaying data, print display device 15 is a printer, input device 16 is a keyboard for setting data and for commanding display monitor change, and auxiliary storage device 17 is for operations such as recording and displaying data. Further, auxiliary storage device 17 may range from a floppy disk device to a huge memory apparatus like a host-computer in a central monitor room.

Display apparatus 10 includes output control device 18 for controlling screen display device 14, print display device 15 or outer processing devices. If a plurality of display apparatus 10 are connected with one host-computer in a monitor room, the host-computer can process casting data from each display apparatus 10, thereby allowing central monitoring of both casting condition and productivity. Display apparatus 10 may further include setting control device 19 for processing data from input device 16, and for communicating with auxiliary storage device 17.

Display apparatus 10 also has an input-calibration device 20 at its introductory part which is comprised of digital signal processors 21, each having a memory 22 for storing sensor-output calibration data on each channel.

Figure 2:
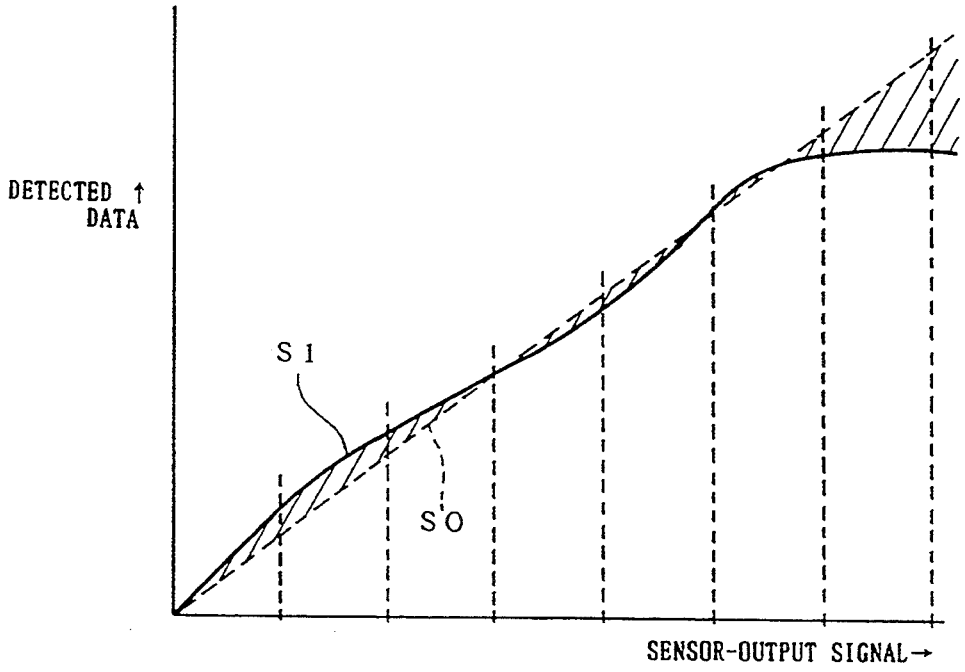
FIG. 2 is a graph showing a sensor output calibration.
Figure 3:
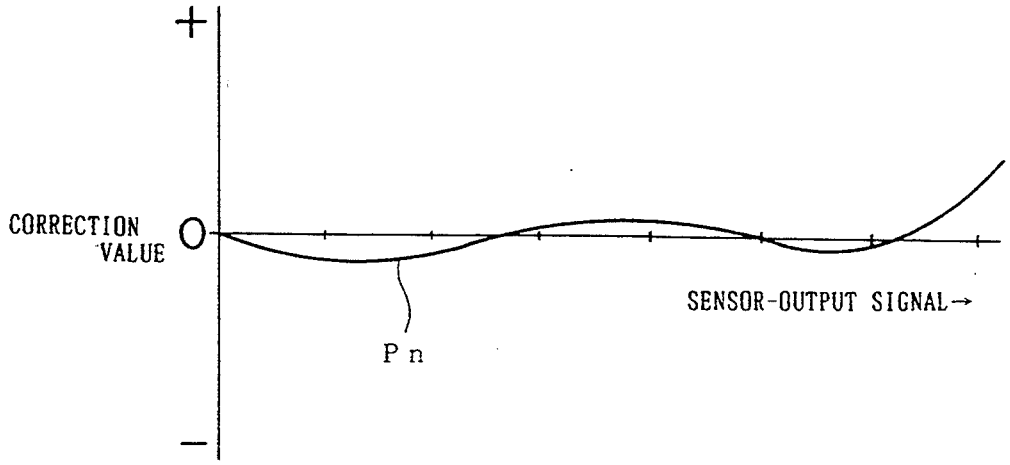
FIG. 3 is a graph showing a calibration data for a sensor.

Digital signal processors 21 receive output signals issued at A/D converter 13 from corresponding sensors 12, correct these signal based on stored sensor-output calibration data 22 for each channel, and issue a detected data signal. This calibration is performed for each sensor 12 and its corresponding channel to determine calibration data sets. For instance, FIG. 2 shows a deviation in sensor 12 between output characteristic S1 and standard characteristic SO from which line Pn of FIG. 3 is determined for setting off the deviation. Accordingly, input-calibration device 20 of display apparatus 10 is able to obtain input data having stable characteristics irrespective of sensors 12.

Figure 4:
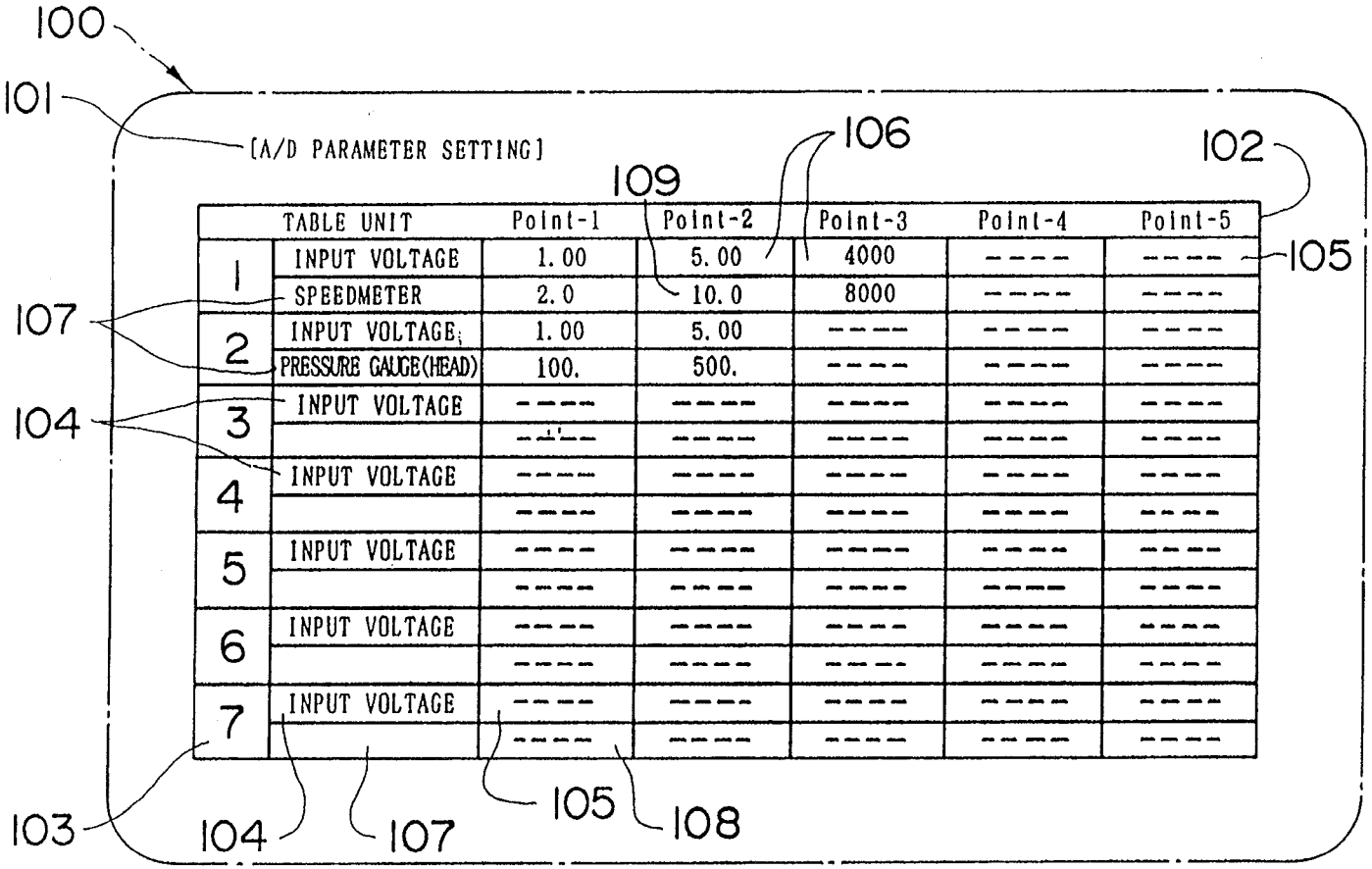
FIG. 4 is a setting screen for calibration data.

Sensor-output calibration data memory 22 is programmed by setting control device 19, wherein input device 16 and screen display device 14 are utilized. When commanding setting control device 19 to set sensor-output calibration data from input device 16, screen display device 14 displays a setting screen 100 as shown in FIG. 4.

At the upper left portion of screen 100 is title 101 explaining the present process. Just below title 101 are a plurality of point representations 102 in a crosswise form which correspond to sensor output. At the left-most portion of screen 100 are channel representations 103 in a lengthwise form corresponding to input channels ch1 through chN. Each channel representation is divided into two rows, wherein an upper row is used for displaying calibration-data type 104 such as "INPUT VOLTAGE" and a lower row is used for displaying position name for sensors 107, such as "SPEEDOMETER". An input frame 105, to the right of the upper row, can then be used for inputting each calibration data point value 106 from input device 16. A representation frame 108, to the right of the lower row, can then be used for displaying each detected-data point value 109 corresponding to the calibration data point value 106. Setting screen 100 describes each characteristic of sensors 12 at every monitored point so that calibration data Pn, as shown in FIG. 3, can be determined.

Casting-cycle data processing device 30 of display apparatus 10 in FIG. 2 can display several items regarding the casting-cycle based on the detected data from input-calibration device 20. It will hereunder be described with reference to FIG. 1B.

Casting-cycle data processing device 30 is able to process data for each cycle (one shot) in die-cast machine 11, and to display fluctuations such as injection speed and injection pressure. Device 30 comprises an input buffer 31 for storing the detected data from input-calibration device 20, a graph display portion 32 for displaying several items based on the contents of input buffer 31, a list display portion 33, and an error display portion 34. Device 30 further includes a graph display format memory 35 for storing predetermined display format data, a list display format memory 36, and an error display memory 37. These are provided so that each display portion 32–34 can be changed in accordance with the contents in each format memory 35–37.

Figure 5:
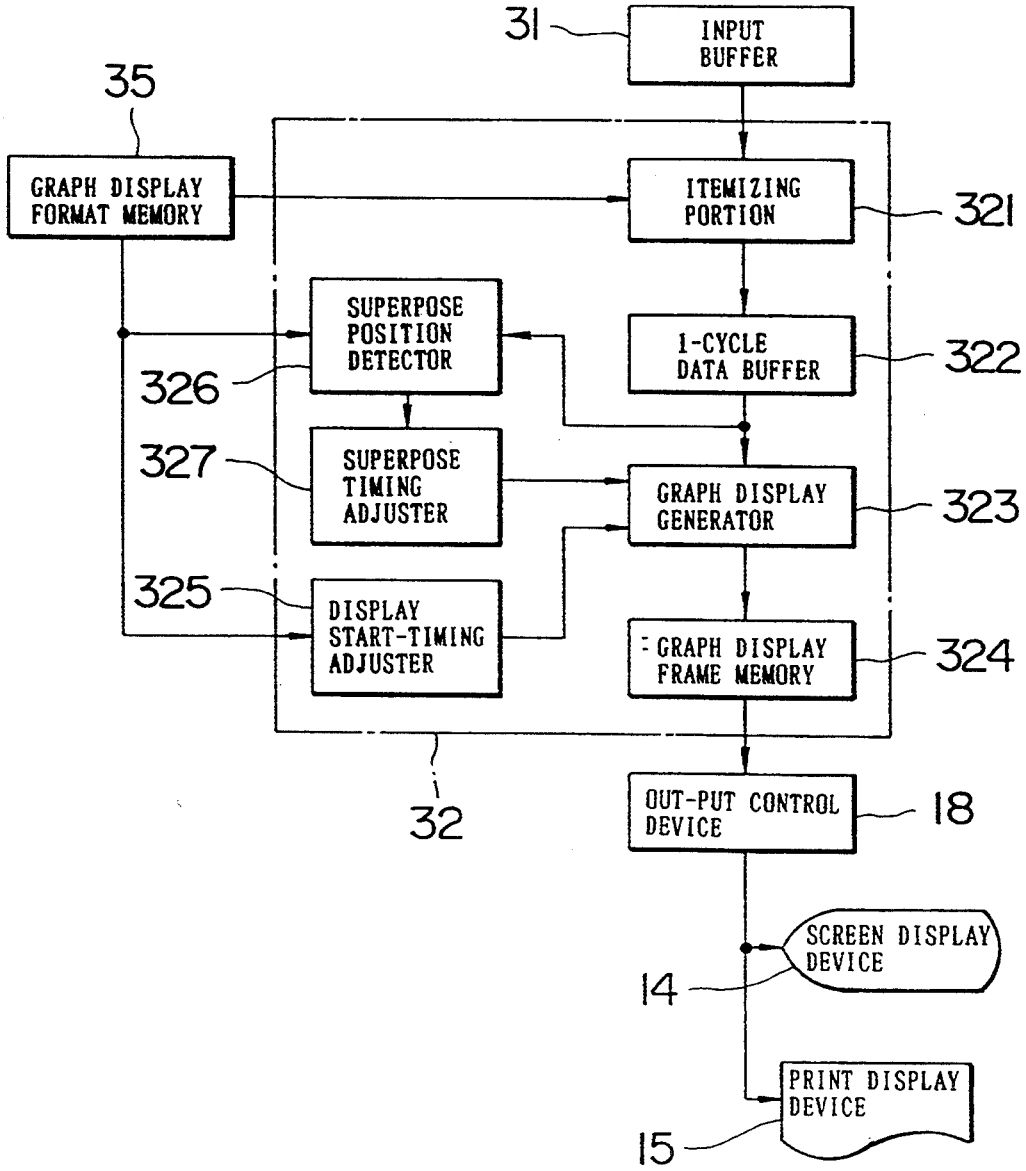
FIG. 5 is a block diagram showing a graph display portion.

FIG. 5 shows the arrangement of graph display portion 32 in casting-cycle data processing device 30. Graph display portion 32 includes an itemizing portion 321, a one-cycle data buffer 322, a graph display generator 323, a graph display frame memory 324, a display start-timing adjuster 325, a superpose position detector 326, and a superpose timing adjuster 327. These components operate as follows.

Itemizing portion 321 picks up necessary data consecutively such as injection speed and injection pressure from input buffer 31 based on items in graph display format memory 35.

One-cycle data buffer 322 stores detected data from itemizing portion 321 for one injection cycle.

Figure 6:
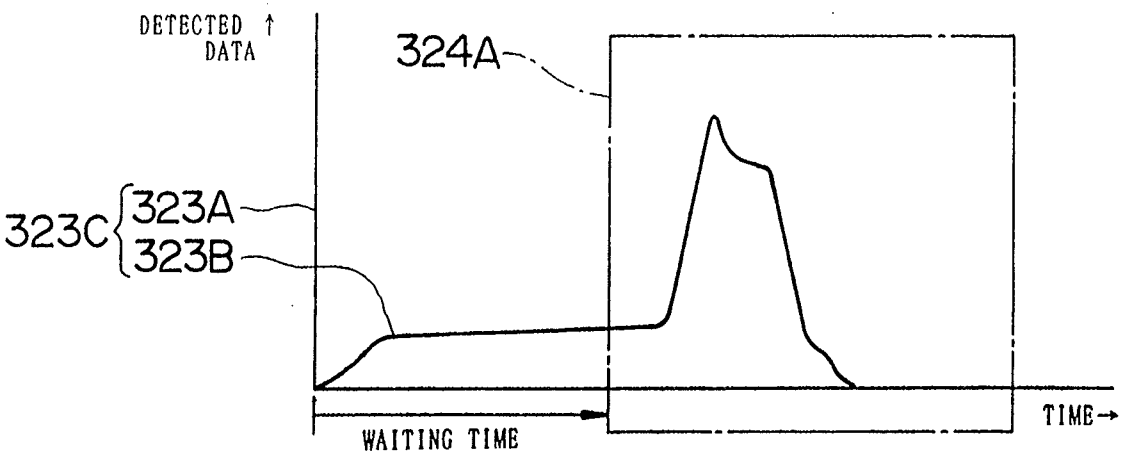
FIG. 6 is a graph showing a graph display condition.

Graph display generator 323 configures the rectangular coordinate system of FIG. 6 having 323A of FIG. 6 having an axis of ordinates corresponding to selected data and an axis of abscissas corresponding to the time injection cycle. Curved line 323B, which displays the detected data stored in one-cycle data buffer 322, is then superimposed on rectangular coordinate system 323, thereby creating graph 323C shown in FIG. 6. Display area 324A is stored in graph display frame memory 324 which is able to describe a stored image on screen display device 14 or print display device 15 via the output control device 18.

Display start-timing adjuster 325 determines a display start position in graph display generator 323 based on a waiting time in graph display format memory 35. It also adjusts the initial position of graph 323C in display area 324A according to this waiting time so that the selected data item is shown in the start-adjusted display format. If the waiting time is not determined, display area 324A is set from the top of graph 323C to display the data in direct display format.

Superimposed position detector 326 examines data in one-cycle data buffer 322 based on standard items for superimposing in graph display format memory 35, and it determines a position for superimposing. Superimpose timing adjuster 327 then adjusts a display timing of graph display generator 323 based on the position for superimposing, and it superimposes the detected data successively.

Figure 7:
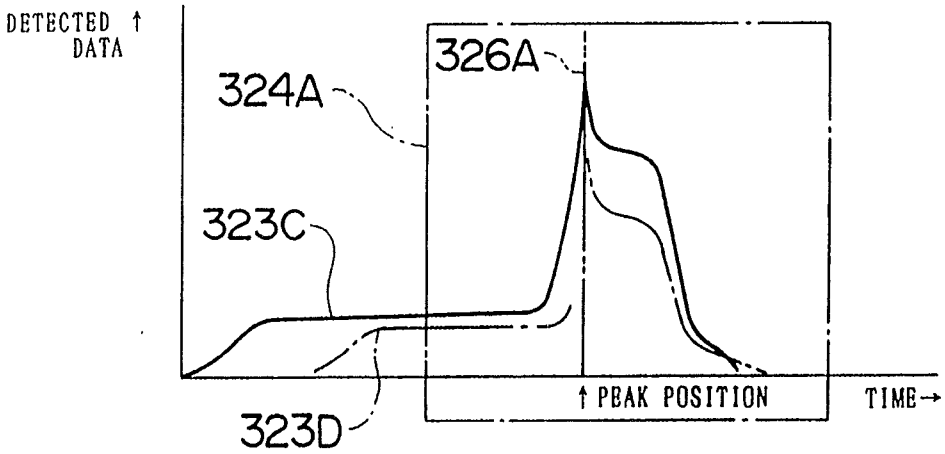
FIG. 7 is a graph in a peak-adjusted display format.

In a peak-adjusted display format, as shown in FIG. 7, a maximum or minimum peak position 326A of data is detected. Display timing is then adjusted so that the detected superimpose position is inside of display area 324A, whereby present graph 323C is superimposed on prior graph 323D such that peak positions of graphs 323C and 323D correspond to each other.

Figure 8:
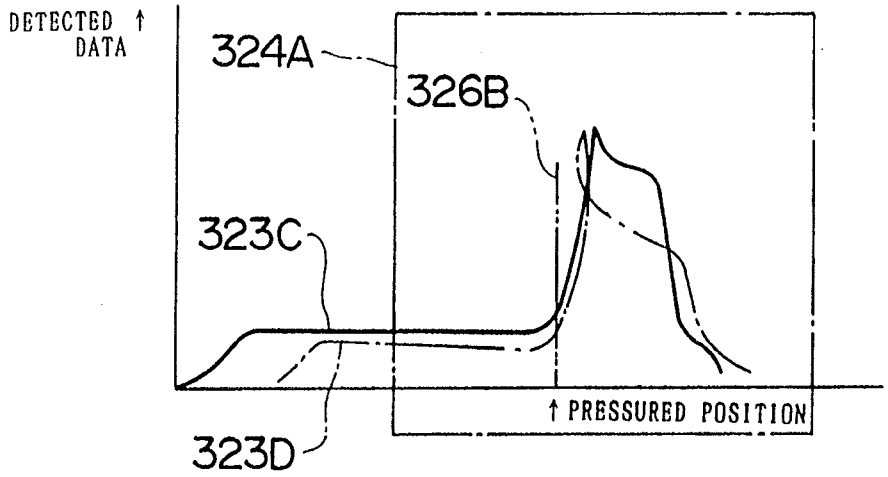
FIG. 8 is a graph in a rise-adjusted display format.

In a rise-adjusted display format, as shown in FIG. 8, a rise position 326B of data is detected, and display timing is adjusted so that the detected superimposed position is inside of the display area 324A. Thus, present graph 323C is superimposed on prior graph 323D such that rise positions both of graphs 323C and 323D correspond to each other.

Figure 9:
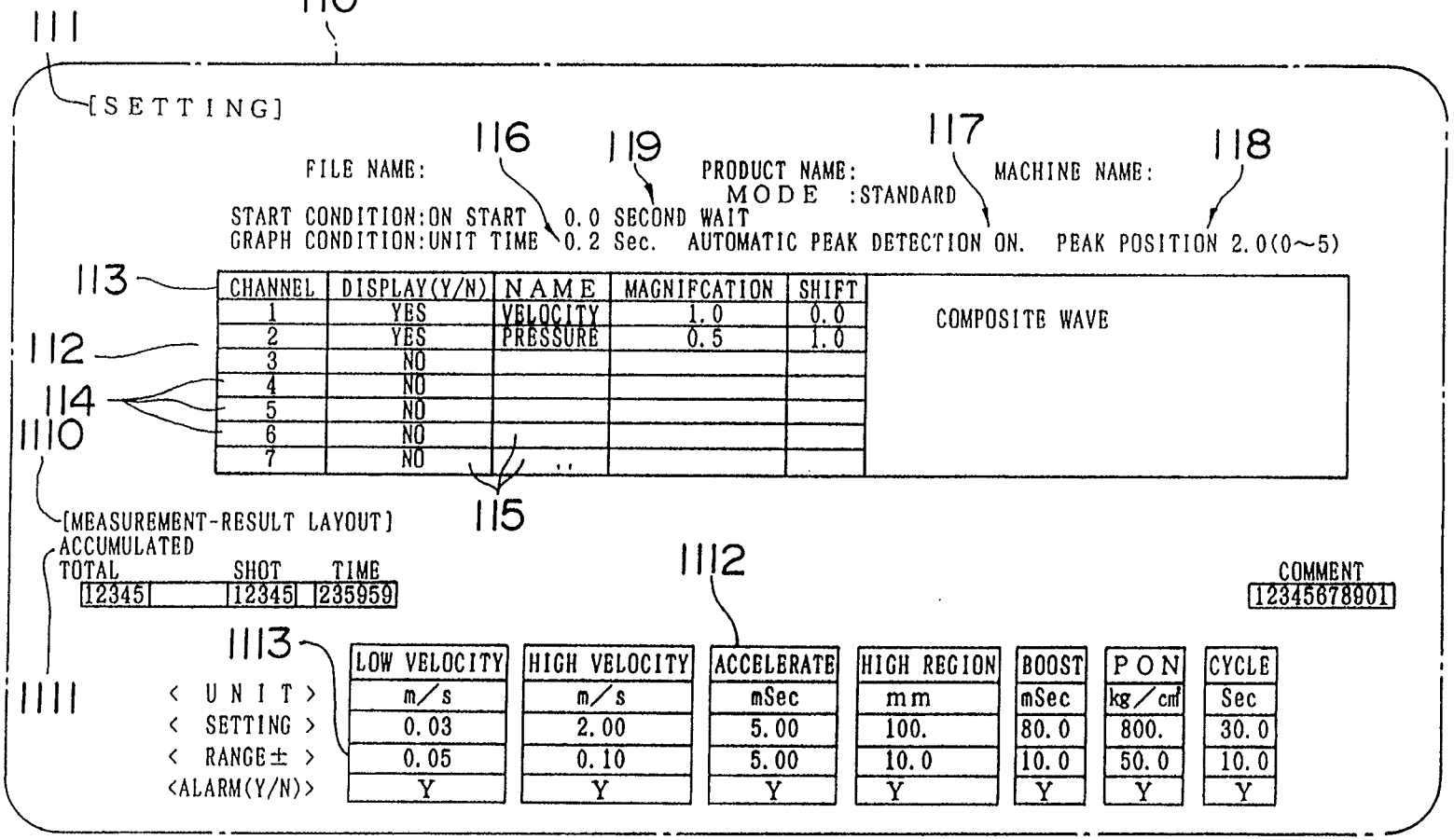
FIG. 9 Is a setting screen for display format.

The contents of graph display format memory 35 are programmed by setting control device 19, wherein input device 16 and screen display device 14 are utilized. While commanding setting control device 19 to set graph display format data from input device 16, screen display device 14 displays setting screen 110 as shown in FIG. 9. The left, uppermost position on setting screen 110 contains title 111 which describes the current process. Center position displays frames 112 has several items 113 such as "CHANNEL", "DISPLAY (Y/N)" "NAME" "MAGNIFICATION", "SHIFT" in an upper portion. The left side of frames 112 is used as channel display 114 for displaying input channels from ch1 to chN consecutively. Right frames 115 of respective channel display frames 114 are for setting items corresponding to items 113 via input device 16. Detected data of channel 1 is displayed with a magnification of 1.0 as injection speed, and detected data of channel 2 is displayed with a magnification of 0.5 as injection pressure.

An upper area of frames 112 located to the right of "'GRAPH CONDITION" is for unit time 116 corresponding to one graduation on the time axis in graph display. The graph display in this embodiment is termed the peak-adjusted display format, wherein the unit time is set at 0.2 seconds, so that the peak position is 2.0. Therefore, a position of $0.2\times2=0.4$ seconds would be determined by an automatic peak detection.

Just above "GRAPH CONDITION", "START CONDITION" and an input frame of waiting time 119 are provided. As shown, zero second is set, therefore, this display would start from the beginning of the injection cycle.

Figure 10:
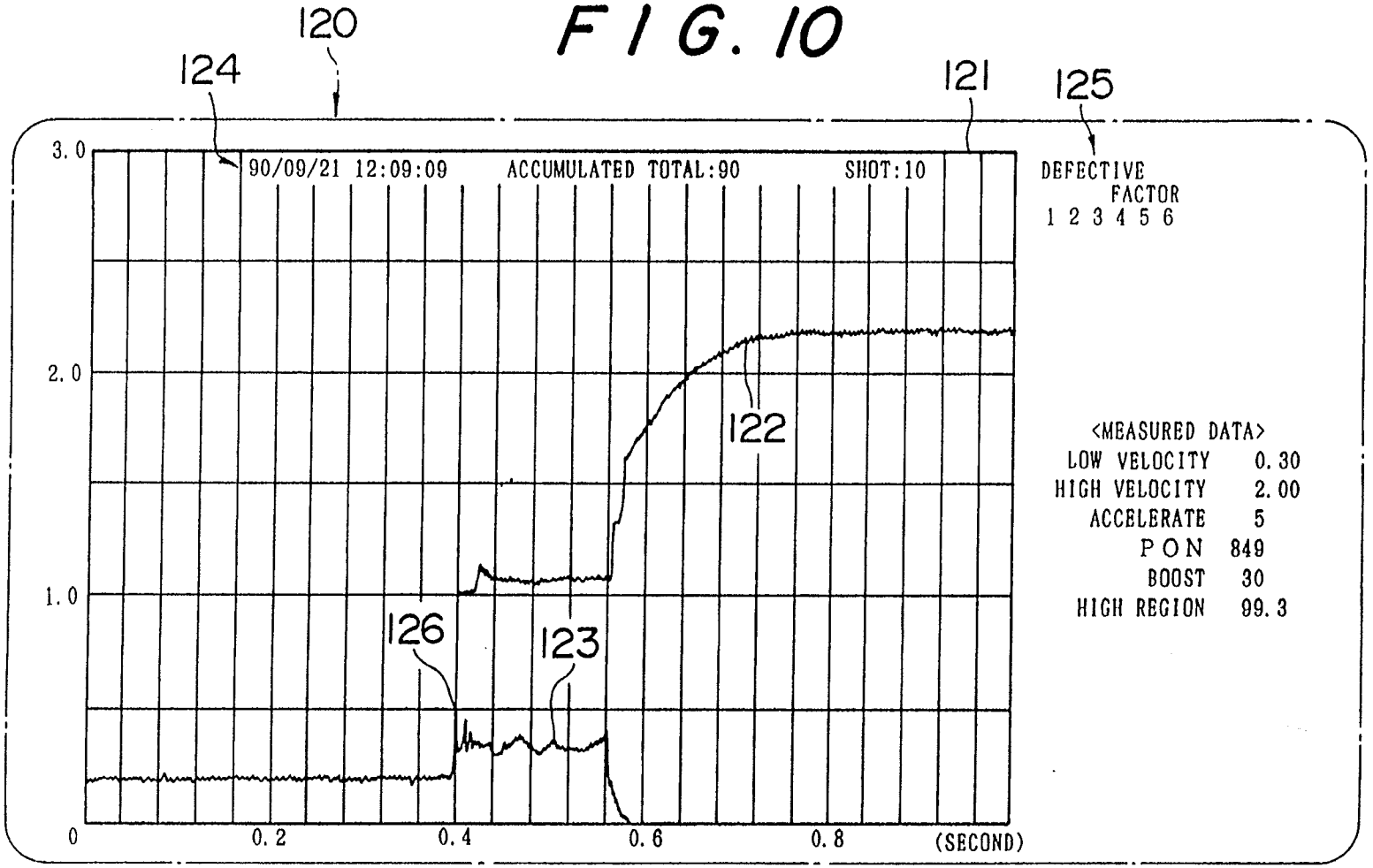
FIG. 10 is a graph display screen.

When graph display format memory 35 is programmed as described and input device 16 commands output control device 18 to perform a graph display, a graph display screen 120 is formed by the graph display portion 32 as shown in FIG. 10.

This graph display screen 120 includes a graph displayed area 121 having a mesh for scale on a rectangular coordinate system. Also included are lines 122 and 123 for displaying the injection pressure fluctuation through the present cycle at the middle portion, and the injection speed fluctuation at the bottom portion. The uppermost area of graph display area 121 is used for progress information 124 such as date, time, accumulated total, and present shot-time. The right area of graph display area 121 is used for additional information 125 such as "DEFECTIVE FACTOR" and "MEASURED DATA".

Screen 120 of FIG. 10 appears when the peak-adjusted display format is chosen in the graph selection field of FIG. 9. Note that first peak position 126 of line 123 is adjusted into 0.4 seconds.

Figure 11:
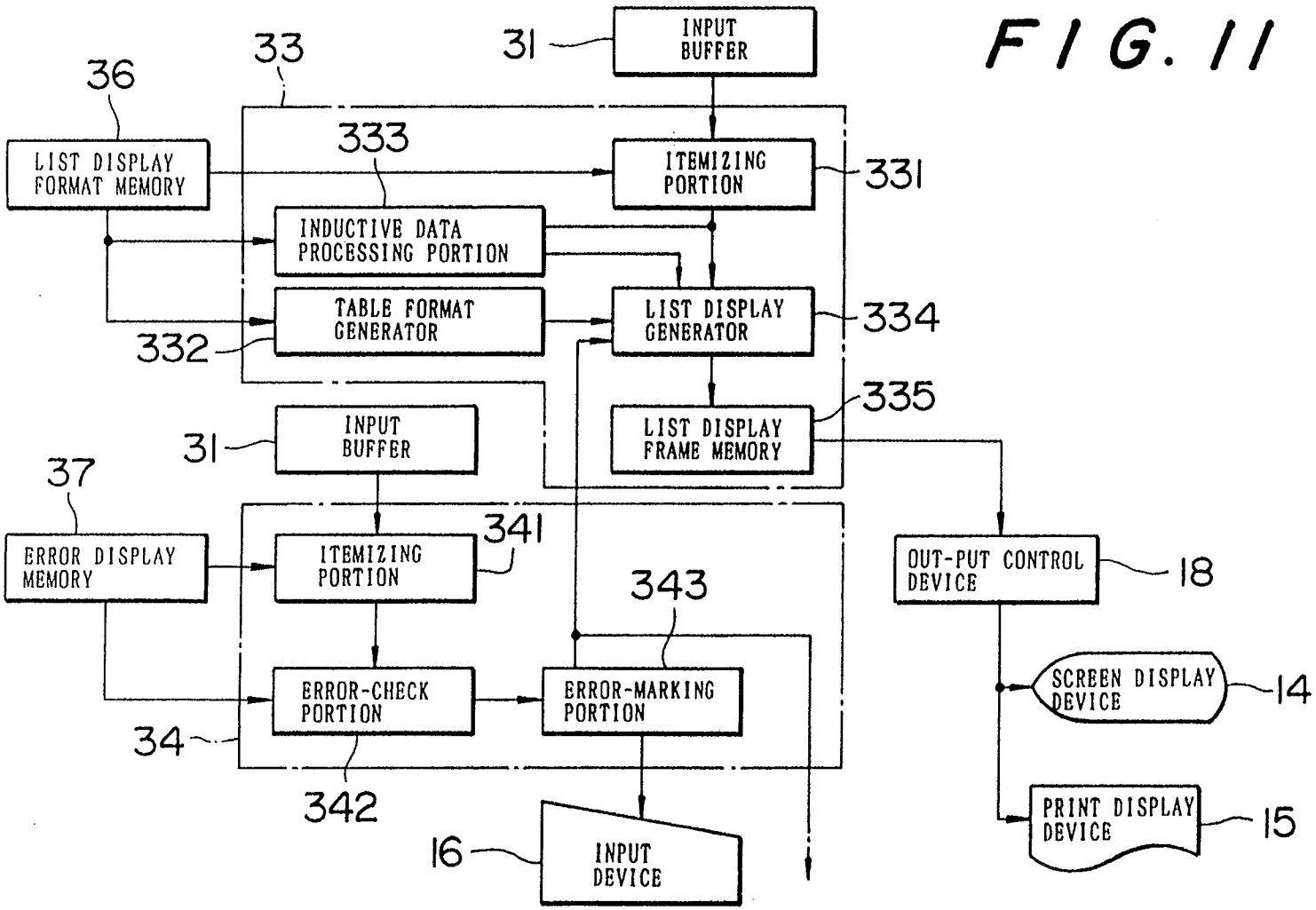
FIG. 11 is a block diagram showing a list display portion and an error display portion.

FIG. 11 shows a structure of list display portion 33 and error display portion 34 in casting-cycle data processing device 30. List display portion 33 includes itemizing portion 331, table format generator 332, inductive data processing portion 333, list display generator 334, and list display frame memory 335, which operate as follows.

Itemizing portion 331 picks up data corresponding to detected data from input buffer 31 based on list display items set in list display format memory 36. List display items include accumulated shot-time and progressed time, slow moving speed, fast moving speed and pressure boost time in an injection cycle.

Table format generator 332 produces a list based on table format data set in list display format memory 36. The list has a title line at the upper area for displaying list items, and data lines at lower area of the title line for displaying corresponding data. Note that the data lines are added consecutively every injection cycle.

Inductive data processing portion 333 can process data based on an inductive data operation expression which is set in list display format memory 36. Inductive data includes data obtained by processing detected data from input buffer 31, and data obtained by combining several pieces of detected data.

List display generator 334 generates a list based on a table which is made in table format generator 332. This generator 334 receives detected data from itemizing portion 331 and inductive data from inductive data processing portion 333. This data is then placed in lines corresponding with the title line and given to list display frame memory 335 in due course.

The list image in list display frame memory 335 can be displayed by screen display device 14 and print display device 15 via output control device 18. List display portion 33 also relates to error display portion 34.

Error display portion 34 comprises an itemizing portion 341, an error-check portion 342 and an error-making portion 343.

Itemizing portion 341 can pick up corresponding data from detected data which has been input to buffer 31 based on error display items set in error display memory 37.

Error-check portion 342 examines detected data picked up by itemizing portion 341 and sends data which is beyond an allowable range or error mark toward error-marking portion 343. The error mark may be a symbol for explaining error, or a simple mark indicating a presence of error.

Error-marking portion 343 transmits received error data and error marks to list display generator 334 of list display portion 33. It then adds error marks to error data. Error-marking portion 343 is connected to input device 16 so that an operator can place optional error marks or comments to the list display using input device 16.

The contents of list display format memory 36 and error display memory 37 are programmed through setting control device 19 by input device 16 and screen display device 14. When the list display format is selected by setting control device 19 through input device 16, setting screen 110 as shown in FIG. 9 is displayed on screen display device 14.

The lower area of screen 110 of FIG. 9 displays subtitle 1110 as "MEASUREMENT-RESULT LAYOUT". Below this subtitle, a display position input frame 1111 including "ACCUMULATED TOTAL", "SHOT", and "TIME" is provided Below and to the right of display position input frame 1111, item input frame 1112 is arranged for setting list display items. Each input frame 1112 has several numerical value input frames 1113 at its lower area for inputting data corresponding to items such as "UNIT", "SETTING", "RANGE ±" and "ALARM (Y/N)" described at the left. "ALARM (Y/N)" is used for determining whether error detection should be provided, "SETTING" is for reference data, and "RANGE ±" is for setting allowable data ranges.

When the settings of list display format memory 36 and error display memory 37 are completed and input device 16 commands output control device 18 to display the list, screen display device 14 or print display device 15 display screen 130, as shown in FIG. 12, specifying both list display portion 33 and error display portion 34.

In FIG. 12, there are four title lines 131 at the top of screen 130. The first line 131 is used for displaying item names 132. The second through fourth lines 131 are used for displaying setting information such as unit, setting value and range which correspond to the displayed titles. A left adjusted column of title lines 131 is used for data lines 134 for each injection cycle. Data line 134 includes counted shot times 135, shot time on conditions 136, and item data 137 corresponding to display items. Data lines 134 are added successively from the top to the bottom in accordance with progress of the injection modes. In several data lines 134, especially in the 44th-shot, 47th-shot and 55th-shot, the error mark "H" is added in "ACCELERATE" and "HIGH REGION" items to indicate shown data is beyond the allowable range. Another error mark "L" is used in the "VH" item for indicating that data is beyond the allowable range. Error mark representation frame 1310 also contains an asterisk to indicate that displayed data is defective, just to the left of the rightmost comment paragraph. These marks are input through input device 16 by an operator to confirm defects when examining produced goods after each shot. A preferable digit place in error mark representation frame 1310 is determined corresponding with defect items, and the asterisk mark is added to the corresponding position. The error mark is not always the above-mentioned asterisk, but also any other marks which may describe degree of defectiveness.

In the following, casting control data processing device 40 will be explained with reference to FIG. 1, based on detected data from input-calibration device 20.

Casting control data processing device 40 can process control data for operation of die-cast machine 11. For example, display shot-time can be processed to provide fluctuation through each cycle or the like. Device 40 comprises input buffer 41 for storing detected data from input calibration device 20, fluctuation display portion 42 for displaying fluctuations based on the contents of input buffer 41, fluctuation display format memory 44 for storing predetermined display format, shot display portion 43, and shot display format memory 45. Display portions 42 and 43 can be used to set display format frequently based on format memories 44 and 45, respectively.

Figure 13:
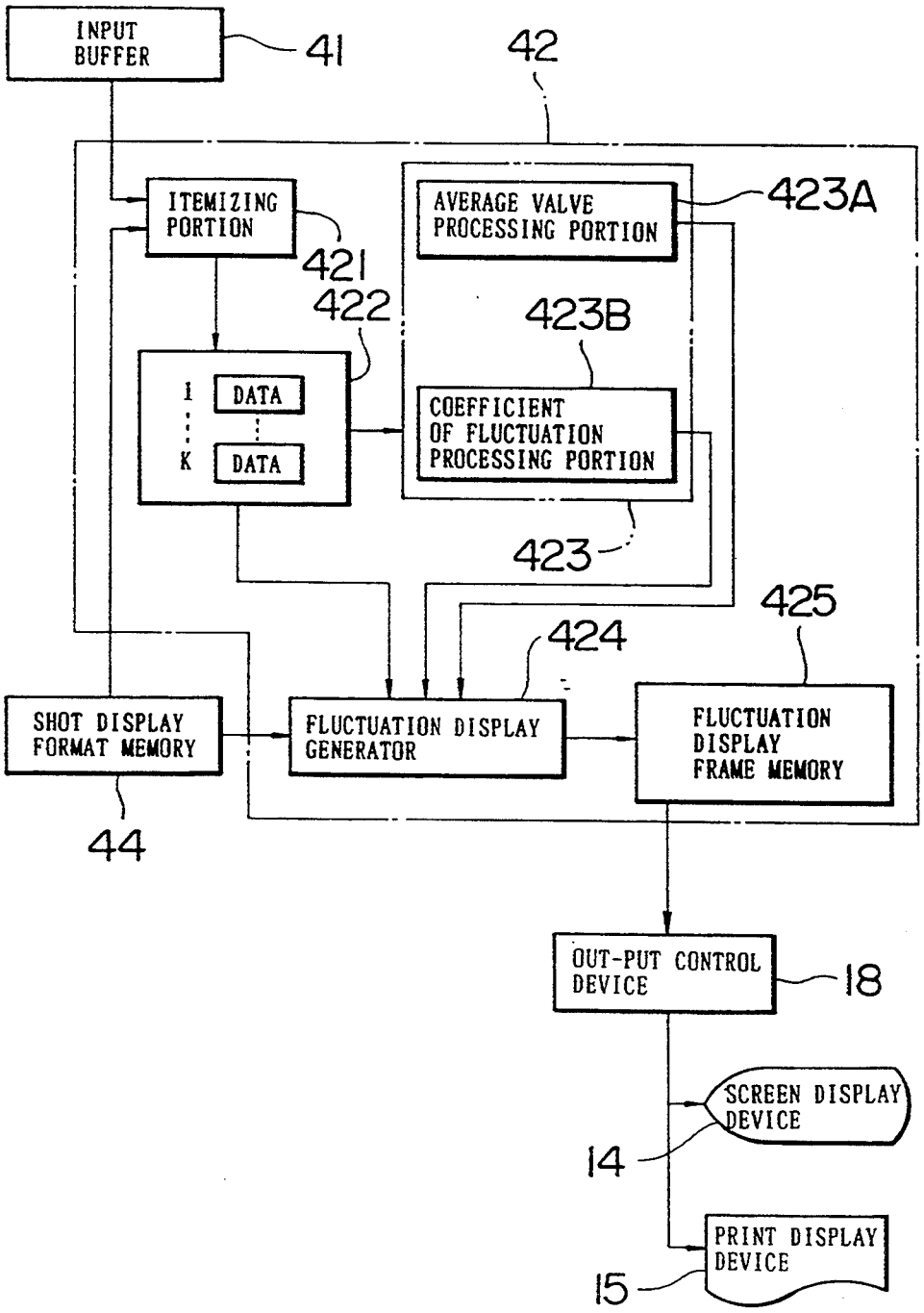
FIG. 13 is a block diagram showing a fluctuation display portion.

In FIG. 13, a structure of fluctuation display portion 42 for casting control data processing device 40 is described. Display portion 42 has itemizing portion 421, data-buffer by shots 422, fluctuation data processing portion 423, fluctuation display generator 424 and fluctuation display frame memory 425.

Itemizing portion 421 picks up data such as injection speed and injection pressure from detected data which has been input to buffer 41 based on fluctuation display items contained in fluctuation display format memory 44. The picked-up data is then recorded in data buffer 422 by injection cycles.

Fluctuation data processing portion 423 is provided to process fluctuation data through an injection cycle in relation to data by shots in data buffer 422. In this process, an average value is determined by the average value processing portion 423A, and a fluctuation ratio is determined by fluctuation processing portion 423B.

Fluctuation display generator 424 functions to display, by shot, both the data stored in the data buffer 422, and fluctuation data processed in fluctuation data processing portion 423. Note that the fluctuation data is based on fluctuation display format set in the fluctuation display format memory 44. In fact, fluctuation data is numerically displayed, and a graph showing fluctuations of data by shots is stored in fluctuation display frame memory 425.

Figure 14:
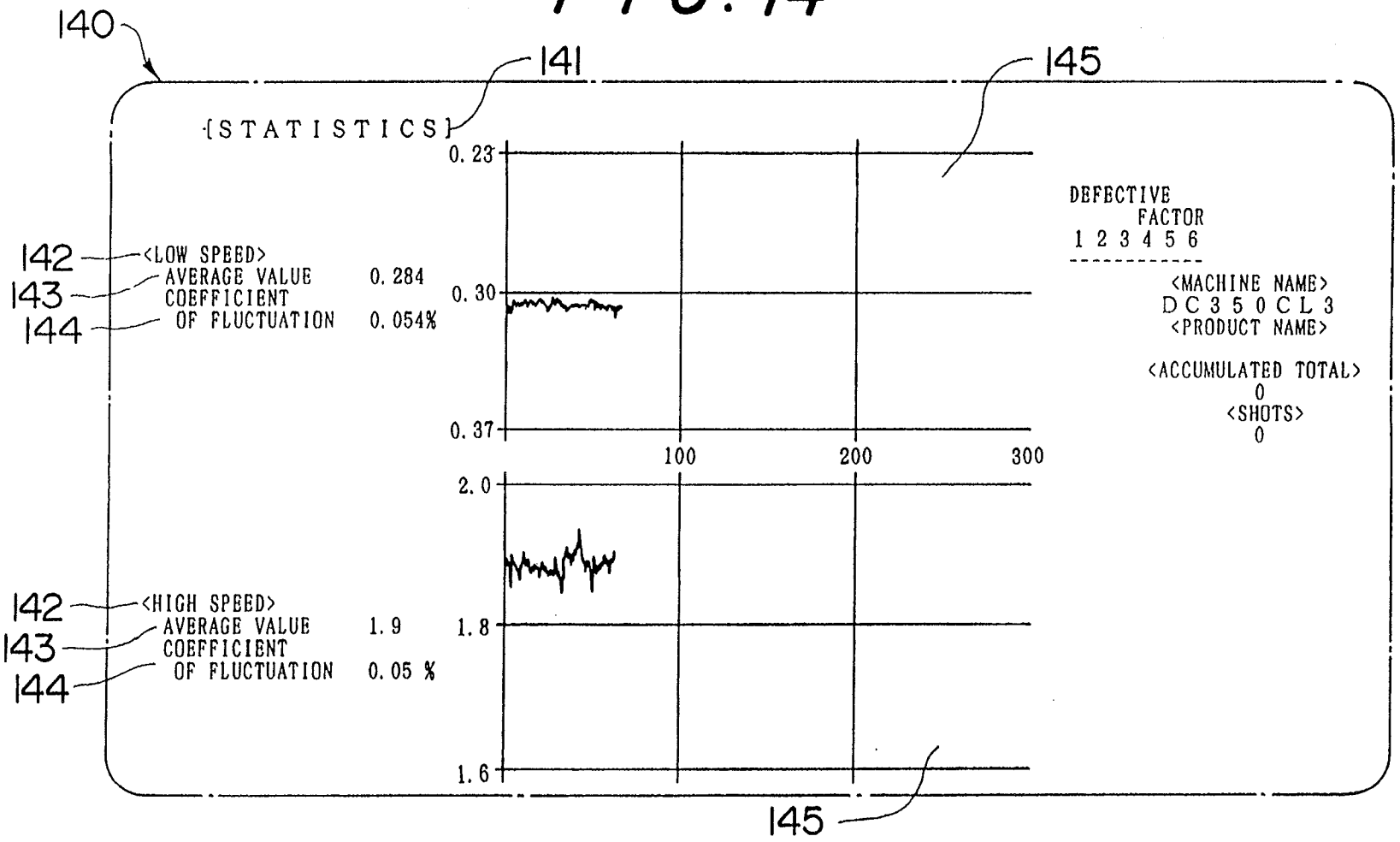
FIG. 14 is a fluctuation display screen.

Fluctuation display frame memory 425 displays recorded images on screen display device 14 or print display device 15 via output control device 18. Hence, when fluctuation display format memory 44 is programmed by setting control device 19 display device 14, and fluctuation display is sent to output control device 18, fluctuation display screen 130 being displayed on screen display device 14 or print display device 15 as shown in FIG. 14.

At the upper left hand corner of screen 140 in FIG. 14, title 141 showing present process is displayed, below which item 142 containing "LOW SPEED" and "HIGH SPEED" is displayed with corresponding regions on its right. The regions are used for displaying average value 143 and coefficient 144 of the fluctuation display. To the right of these regions, plotted data, by shots, are displayed on graph 145 having an axis of ordinates for representing data by shots, and an axis of abscissas for representing shot-time.

In FIG. 15, a structure of shot display portion 43 of casting control data processing device 40 is described.

Shot display portion 43 includes a group of registers 431 for shot display, a shot display generator 432, and a shot display frame memory 433.

Further, the group of registers 431 contained in the shot display portion 43 is comprised of current shot counter 51, defective shot counter 52, total shot register 53, effective shot counter 54, remaining shot counter 55, cycle time register 56, remaining time counter 57, shot counter by conditions 58, and shot time memory by conditions 59 all of which function as follows.

Current shot counter 51 monitors the injection cycle based on detected data from input buffer 41 and counts the current shot St which indicates the total injection cycle times.

Defective shot counter 52 monitors error detection in error display portion 34, memorizes shot time and defect items as data by shots Di, and counts shot times as defective shot number Si when detecting an error.

Total shot register 53 keeps planned injection times as total shots based on the setting in shot display format memory 45.

Effective shot counter 54 stores effective shots Sn by subtracting defective shot number Si of defective shot counter 52 from current shot St of current shot counter 51.

Remaining shot counter 55 calculates and stores remaining shots Sr1 by subtracting effective shots Sn of effective shot counter 54 from total shots So of total shot register 53. It also calculates and stores remaining shots Sr2 by subtracting current shot St from total shots So.

Cycle time register 56 keeps the necessary time per shot as cycle time ts based on the setting of shot display format memory 45.

Remaining time counter 57 stores rest time tr which is cycle time ts of cycle time register 56 multiplied by remaining shots Sr (Sr1 or Sr2) of remaining shot counter 55.

Shot counter by conditions 58 monitors the injection cycle and casting control device 11A for controlling die-cast machine 11. Counter 58 also counts shot time by conditions, which refers to total shot number during equivalent casting conditions. It then records this number in shot time memory by conditions 59.

Shot time memory by conditions 59 stores casting condition and shot time under the condition as data by conditions Dc. Incidentally, shot counter by conditions 58 examines shot times memory by conditions 59 whenever a setting condition in casting control device 11A is changed. If data by conditions Dc is equivalent to new setting data, shot time of data by conditions Dc is read and count is continued.

Based on shot display format set in shot display format memory 45, shot display generator 432 writes counters of both the shot display registers and registers 51–59 into fluctuation display frame memory 425. In this display format, data displays are preferably produced and superimposed as a standard. A particular item is shown as a bar chart in FIG. 16.

Shot display frame memory 433 of shot display portion 43 displays written images on screen display device 14 or print display device 15 via output control device 18.

Figure 16:
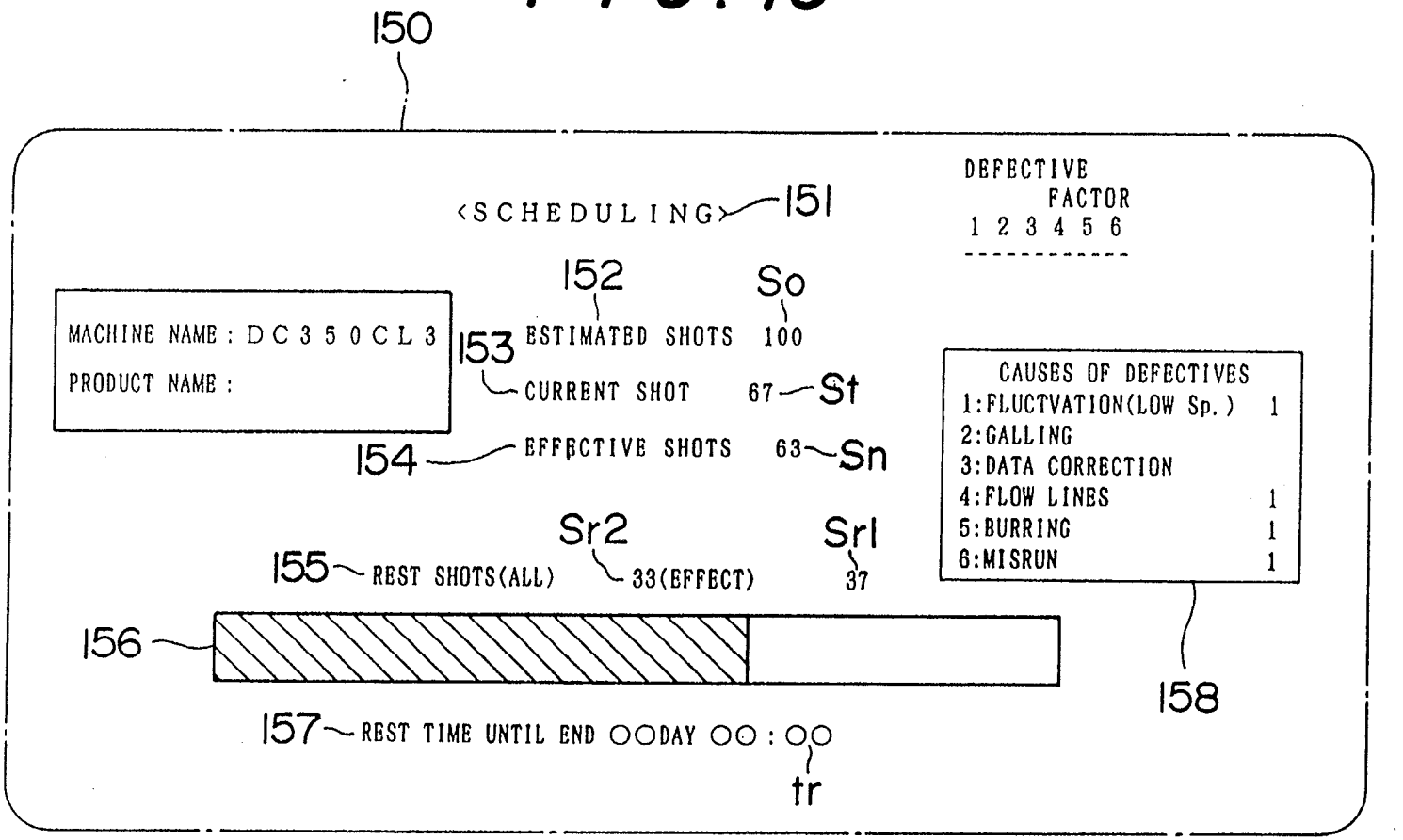
FIG. 16 is a shot display screen.

Accordingly, when a preferable setting in shot display format memory 45 is received by setting control device 19, and when shot display is sent by input device 16 to output control device 18, either on screen display device 14 or print display device 15 displays shot display screen 150, as shown in FIG. 16.

In FIG. 16, the upper area of screen 150 contains title 151 showing the current process. The lower area displays items 152, 153 and 154 as "ESTIMATED SHOTS", "CURRENT SHOT" and "EFFECTIVE SHOTS". On the right side of respective items are total shots So, current shot St, and effective shots Sn. Preferably displayed just below the mentioned items are "REMAINING SHOT" 155, horizontally extended bar graph 156, and "REMAINING TIME UNTIL END" 157.

Remaining shots Sr2 which are calculated from total shots So are displayed to the right of item 155, following "ALL". Remaining shots Sr1 which are calculated from effective shots Sn are displayed just after "EFFECT", remaining time tr is displayed to the right of item 157, and bar graph 156 corresponds to remaining time tr. The shots St, Sn, Sr2, Sr1, remaining time tr, and bar graph 156 can be renewed in accordance with the progress of the casting operation. At the upper right hand corner, defective shot display 158 is provided, wherein shots are displayed according to the contents in defective shot counter 52.

Figure 17:
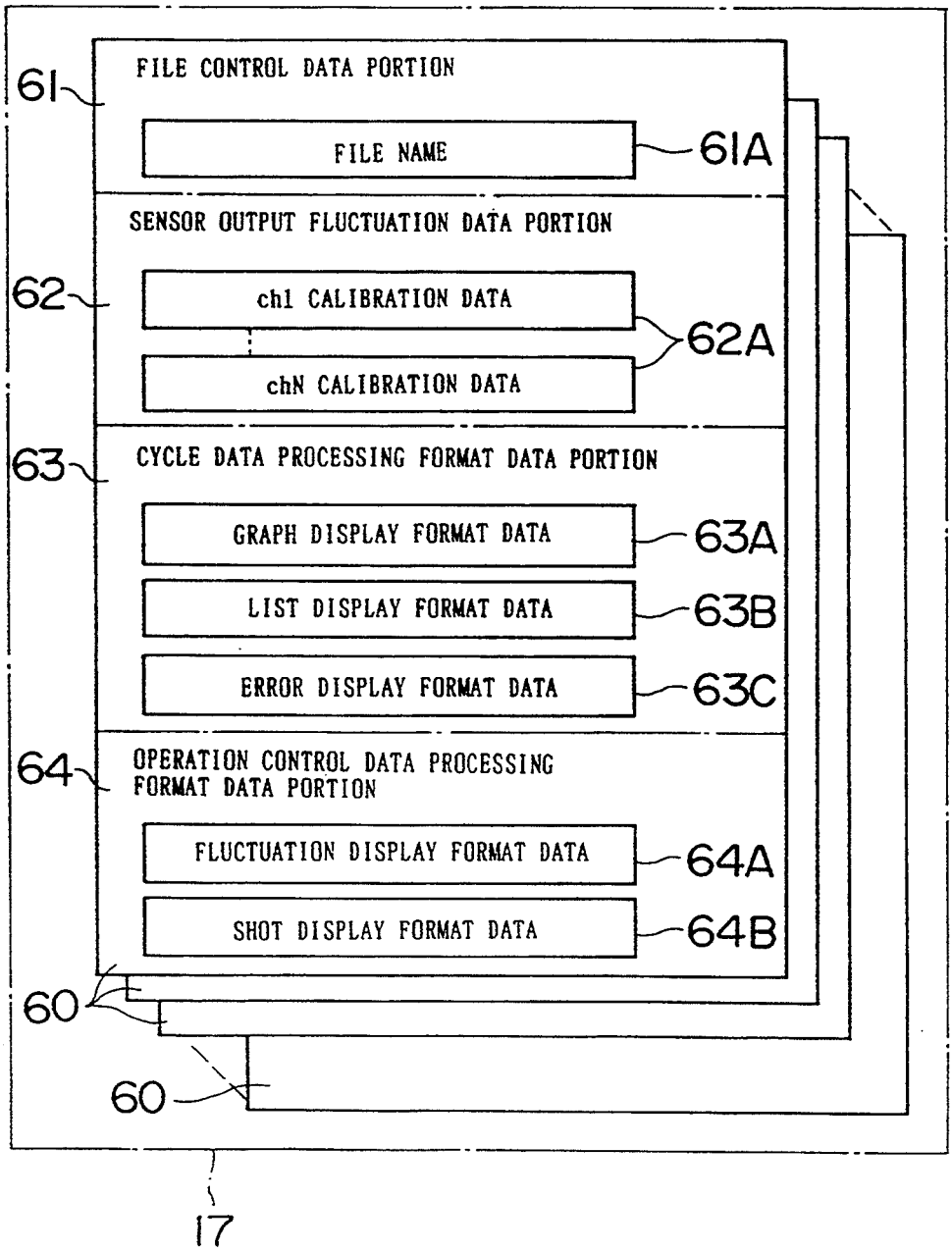
FIG. 17 is a conception chart showing file construction of an auxiliary memory device.

In FIG. 1, setting control device 19 not only functions to set each memory 22–45 by the mentioned external operation, but also to store setting contents of each memory 22–45 in auxiliary storage device 17. Device 19 can store contents read from auxiliary storage device 17 into each memory 22–45. As shown in FIG. 17, auxiliary storage device 17 stores a plurality of display format data files 60. These files are comprised of a file control data portion 61, a sensor output calibration data portion 62, a cycle data processing format data portion 63, and an operation control data processing format data portion 64.

File control data portion 61 is provided to record file name 61A of file 60 as well as other file control data such as product name or product code.

Sensor output calibration data portion 62 is provided to record sensor output calibration data set in sensor output calibration data memory 22 and to store N pieces of calibration data corresponding to input channels ch1–chN.

Cycle data processing format data portion 63 is provided to record graph display format data 63A and to list display format data 63B and error display format data 63C which are set in respective display format memories 35–37 of casting-cycle data processing device 30.

Operation control data processing format data portion 64 is provided to record fluctuation display format data 64A, and to shot display format data 64B which is set in respective display format memories 44, 45 of casting control data processing device 40.

In the following, setting operation of display format and auxiliary record operation of setting memory contents will be explained.

Figure 18:
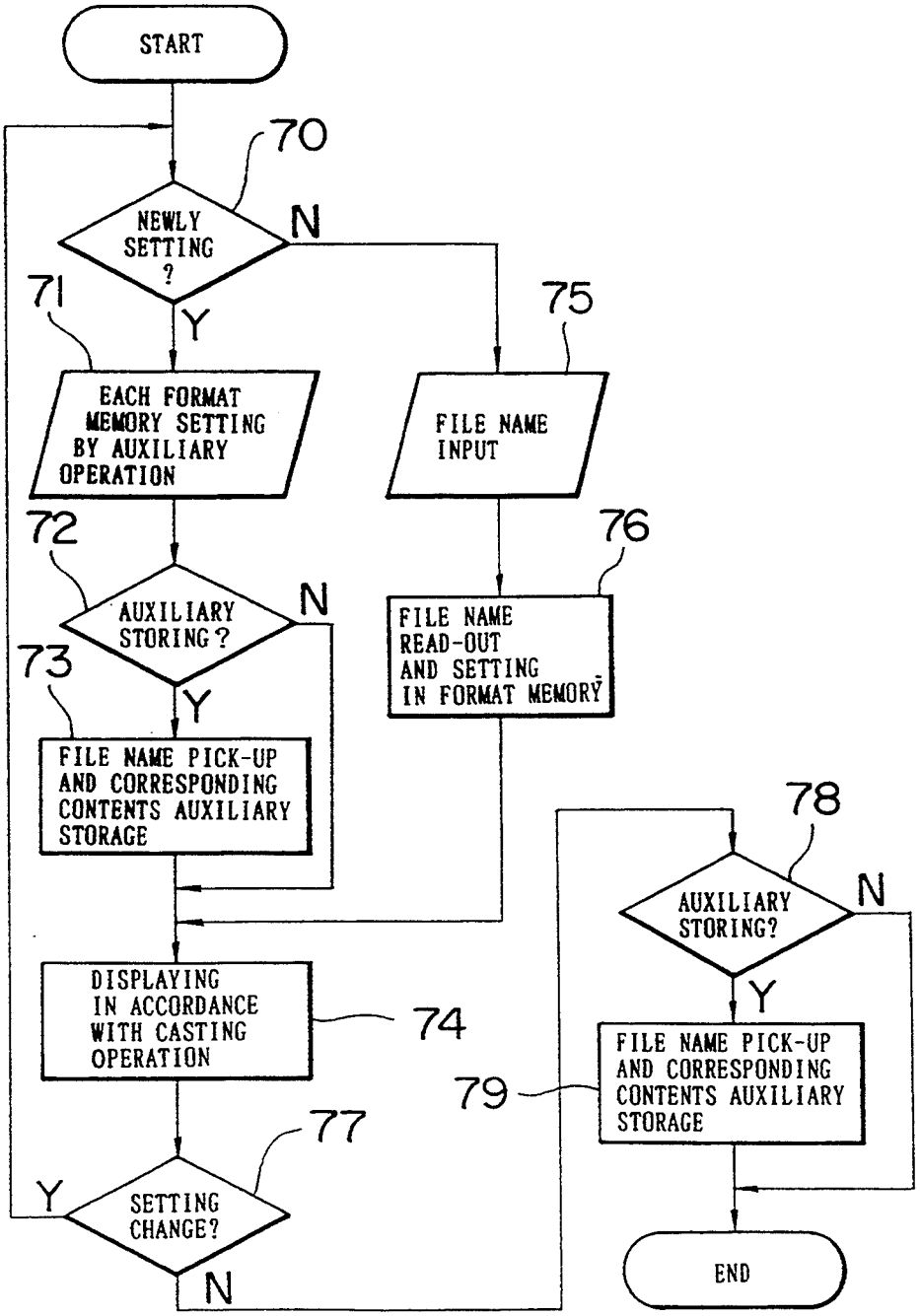
FIG. 18 is a flow chart showing setting and external storing processes.

In FIG. 18, at the beginning of casting-data display apparatus 10 operation, the display format should be preliminary set, choosing whether a new setting is necessary (Process 70).

When new setting is performed, each display format in respective format memories are set by auxiliary operation (Process 71).

Method of storing setting memory is then determined (Process 72). When stored, file name is designated, auxiliary storing operation is performed, and the contents of respective memories are stored in auxiliary files (Process 73).

When not stored, setting is performed according to the display format externally stored. When externally stored display format is used, the file name of the auxiliary file must be designated, corresponding display format must be recorded, and data must be read into file (Process 74). The designated auxiliary file is then read from auxiliary memory and its contents are set in respective format memories (Process 75).

After setting each format memory, the die-cast machine will start the casting operation. While in operation, apparatus 10 conducts various displays based on the set display format (Process 76) .

When casting operation is finished, casting operation parameters are displayed (Process 74), and a determination is made whether a setting of apparatus 10 change is necessary (Process 77).

If necessary, Process 71 is returned to, and the process is repeated. However, if necessary, setting change can be done through casting operation.

If the setting change is not necessary, a determination is made concerning auxiliary storage of setting data (Process 78). When stored to auxiliary memory, the file name is designated, and the contents of format memories are stored to auxiliary files (Process 79). This leads to external storage and repetition of fine settings.

Through this embodiment, the following effects can be attained.

Casting-data display apparatus 10 can display data based on a predetermined display format so that a user can change display format, if necessary. Various data can be easily monitored leading to increases in monitoring efficiency. Display formats can be selected and adjusted depending upon monitoring needs. For instance, using a graph display may provide data fluctuation per injection cycle. The data fluctuation per cycle can be shown under either the peak-adjusted display format or the rise-adjusted display format for superimposing data. List display format allows total monitoring throughout injection cycles, whereby data lines are added per cycle in accordance with selected items so that necessary items can be monitored comfortably. Operation expression can also be optionally added to list display format, so that necessary data display can be performed. Furthermore, if error display is used, error monitoring can be performed, whereby error marks are placed near defective data indicating high or low data.

Using shot time display, various kinds of shot time can be monitored indicating progress of the casting operation. Items of shot time are selective, so that necessary item display may be used for fine monitoring, and fluctuation display may be used for monitoring fluctuations of only selected data per shot.

When setting displays, screen display device 14 and input device 16 are well utilized. However, the setting can be restricted to setting control device 19 only for simplified operation.

The substance of a setting can be stored in an auxiliary portion so that when display is needed for the same condition, the stored display format can be easily recalled.

Casting data display apparatus 10 calibrates input from sensors 12 using calibration data so that any types of sensors can be applied to the apparatus. The mentioned calibration data can also be stored externally to reduce operational burden.

The present invention is not limited in this embodiment, any modifications attaining the same objects should be included.

For example, as for casting-data display apparatus 10, die-cast machine 11, sensors 12, A/D converter 13, screen display device 14, print display device 15, the input device 16, and auxiliary storage device 17, types, performance, numbers and construction are flexible as necessary.

Circuit construction of casting data display apparatus 10 having input calibration device 20, casting cycle data processing device 30, and casting control data processing device 40 can also be arranged as necessary.

The graph display and the list display selective in devices 30, 40 can be arranged and, if necessary, display portions 31–34, 42, 43 can be disposed.

Display screens 120, 130, 140, 150 in display portions 31–34, 42, 43 or setting screens 100, 110 by setting control device 19 can be arranged as necessary.

As has been mentioned, according to the present invention, a user can easily arrange or select the display format so that effective monitoring can be performed.

What is claimed is:

1. A method of displaying casting-data in a die-cast machine which indicates casting operation condition of the die-cast machine after processing output signals from sensors disposed at several points in the die-cast machine, said method comprising the steps of:

selecting at least one sensoring output as data to be displayed before beginning casting operation;

setting a rectangular coordinate system for displaying data values of the selected data items, wherein one axis of the rectangular coordinate system is a data value axis, for representing the selected data items, and another axis is a time axis for representing time progress in one injection cycle; and selecting one of four display formats, wherein the first format is a direct display format for displaying the data values of a present injection cycle, the second format is a start-adjusted display format for displaying the data values wherein a start position on the time axis is adjusted to a predetermined time after a present injection cycle start signal has been issued, the third format is a peak-adjusted display format for adjusting a peak position of the data values according to a predetermined position on the time axis, and the fourth format is a rise-adjusted display format for adjusting a point where the actual data value exceeds a predetermined value according to a predetermined position on the time axis, so that the data values of the selected data item are superimposed on the selected rectangular coordinate system successively in accordance with the selected display format.

2. A method of displaying casting-data in a die-cast machine according to claim 1, said method further comprising the steps of;

setting calibration data for each sensor before casting operation, and correcting each sensor output signal using the calibration data.

3. A method of displaying casting-data in a die-cast machine according to claim 1, said method further comprising the steps of;

storing setting and format data in an auxiliary file, and reading out the setting and format data from the auxiliary file for setting operation.

4. A method of displaying casting-data in a die-cast machine according to claim 1, said method further comprising the step of transmitting the display contents to an auxiliary processing device.

5. A method of displaying casting-data in a die-cast machine which indicates casting operation conditions, said method comprising the steps of:

monitoring a plurality of sensors which are disposed at respective positions within the die-cast machine and generate data items indicative of conditions being sensed;

selecting a plurality, but less than all, of the data items to be displayed;

setting an allowable range and an error mark for each selected data item before a casting operation, and adding the error mark to each selected data item which exceeds the allowable range;

setting each display position for the selected data items before the casting operation;

displaying the selected data items at title lines on the display, whereby at least titles of the selected data items are shown during the casting operation; and displaying present values of the selected data items consecutively on data lines divided at every injection cycle with the display positions of the selected data items.

6. A method of displaying casting-data in a die-cast machine according to claim 5 wherein the error mark is manually set according to a measured result of products before casting operation, and is added to the data items as representation thereof.

* * * * *